US006276958B1

(12) United States Patent
Chih

(10) Patent No.: US 6,276,958 B1
(45) Date of Patent: Aug. 21, 2001

(54) FLEXIBLE PRINTED CIRCUIT CONNECTOR WITH A RELIABLY ANCHORED SLIDER

(75) Inventor: Kuo-Hua Chih, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/729,734

(22) Filed: Dec. 4, 2000

(51) Int. Cl.[7] ..... H01R 12/24
(52) U.S. Cl. ..... 439/495; 439/357
(58) Field of Search ..... 439/495, 496, 439/492, 493, 497, 329, 357, 358

(56) References Cited

U.S. PATENT DOCUMENTS 5,354,214 * 10/1994 Aso et al. ..... 439/492
5,474,468 * 12/1995 Chishima et al. ..... 439/495
5,501,610 * 3/1996 Ikemoto ..... 439/498
5,688,143 * 11/1997 McHugh et al. ..... 439/495
6,165,008 * 12/2000 Wu et al. ..... 439/492

* cited by examiner

*Primary Examiner*—Tulsidas Patel
(74) *Attorney, Agent, or Firm*—Wei Te Chung

(57) ABSTRACT

A flexible printed circuit (FPC) connector includes an insulating housing (10) receiving contact elements (20) therein, and a slider (40) insertably mounted to the housing. A pair of solder pads (30) are mounted on opposite sides of the housing. The slider forms a pair of latching arms (404) and a pair of latching flukes (405) projecting inwardly from front ends of the latching arms. Each solder pad defines a gap (307) between a first and a second mounting walls (304, 305). A projection (306) is formed on an outer surface of each first mounting wall. When the slider is in a first position, each latching fluke extends into the gap and locks with an edge of the second mounting wall of a corresponding solder pad. When the slider is in a second position, each fluke locks with the projection of the first mounting wall of the corresponding solder pad.

8 Claims, 7 Drawing Sheets

FLEXIBLE PRINTED CIRCUIT CONNECTOR WITH A RELIABLY ANCHORED SLIDER

FIELD OF THE INVENTION

The present invention generally relates to the art of electrical connectors, and more particularly, to a flexible printed circuit (FPC) connector having reliable latching mechanisms between a drive member and an insulating housing of the connector.

BACKGROUND OF THE INVENTION

A wide variety of flexible printed circuit (FPC) connectors are provided for interconnecting flexible printed circuits (FPCs) with printed circuit boards. A typical FPC connector includes an insulating housing, contact elements received in the housing, and a drive member rotatably mounted onto the housing and/or insertable into the housing for pressing an FPC against the contact elements. Latching mechanisms of various designs are proposed for this purpose.

A conventional FPC connector is disclosed in U.S. Pat. No. 5,308,262, wherein a plastic molded housing integrally forms a pair of detent projections. Corresponding engagement steps of a lock-on insert are locked with the detent projections. However, the integral configuration weakens both the housing and the detent projections, which is a disadvantage for providing a reliable latching mechanism, and also makes soldering inconvenient.

U.S. Pat. No. 5,354,214 discloses another conventional FPC connector having a dielectric housing and a pair of separately formed latch/mounting clips. Camming latch embosses of an actuator lock with the latch/mounting clips when an FPC is inserted into the connector. However, the latching assembly is not convenient to use when removing the FPC.

BRIEF SUMMARY OF THE INVENTION

A main object of the present invention is to provide a flexible printed circuit (FPC) connector having a latching mechanism which reliably engages a slider with a housing thereof.

Another object of the present invention is to provide an FPC connector with an improved slider for firmly retaining an FPC.

A further object of the present invention is to provide an FPC connector having an improved housing structure.

A flexible printed circuit (FPC) connector according to the present invention includes a substantially rectangular insulating housing, a plurality of contact elements received in the housing, a slider insertably mounted to the housing, and a pair of solder pads mounted on opposite sides of the housing for securing the electrical connector to a printed circuit board. The insulating housing defines a hollow portion for receiving the slider between opposite side walls thereof. A cutout is defined in a lower portion of each side wall. The slider has a pair of latching arms on opposite sides thereof. A latching fluke projects inwardly from a front end of each latching arm. Each solder pad has a first and a second mounting walls. A gap is defined between a corresponding first and second mounting walls. A projection is formed on each first mounting wall. When the slider is in a first position, the latching fluke of each latching arm enters through the gap of a corresponding solder pad, into a corresponding cutout of the housing, and locks with a front edge of the second mounting wall of the corresponding solder pad. When the slider is in a second position, the latching fluke of each latching arm locks with the projection of a corresponding first mounting wall.

Other objects, advantages and novel features of the invention will become more apparent from the following detailed description when taken in conjunction with the accompanying drawings.

DETAILED DESCRIPTION OF THE INVENTION

Figure 1:
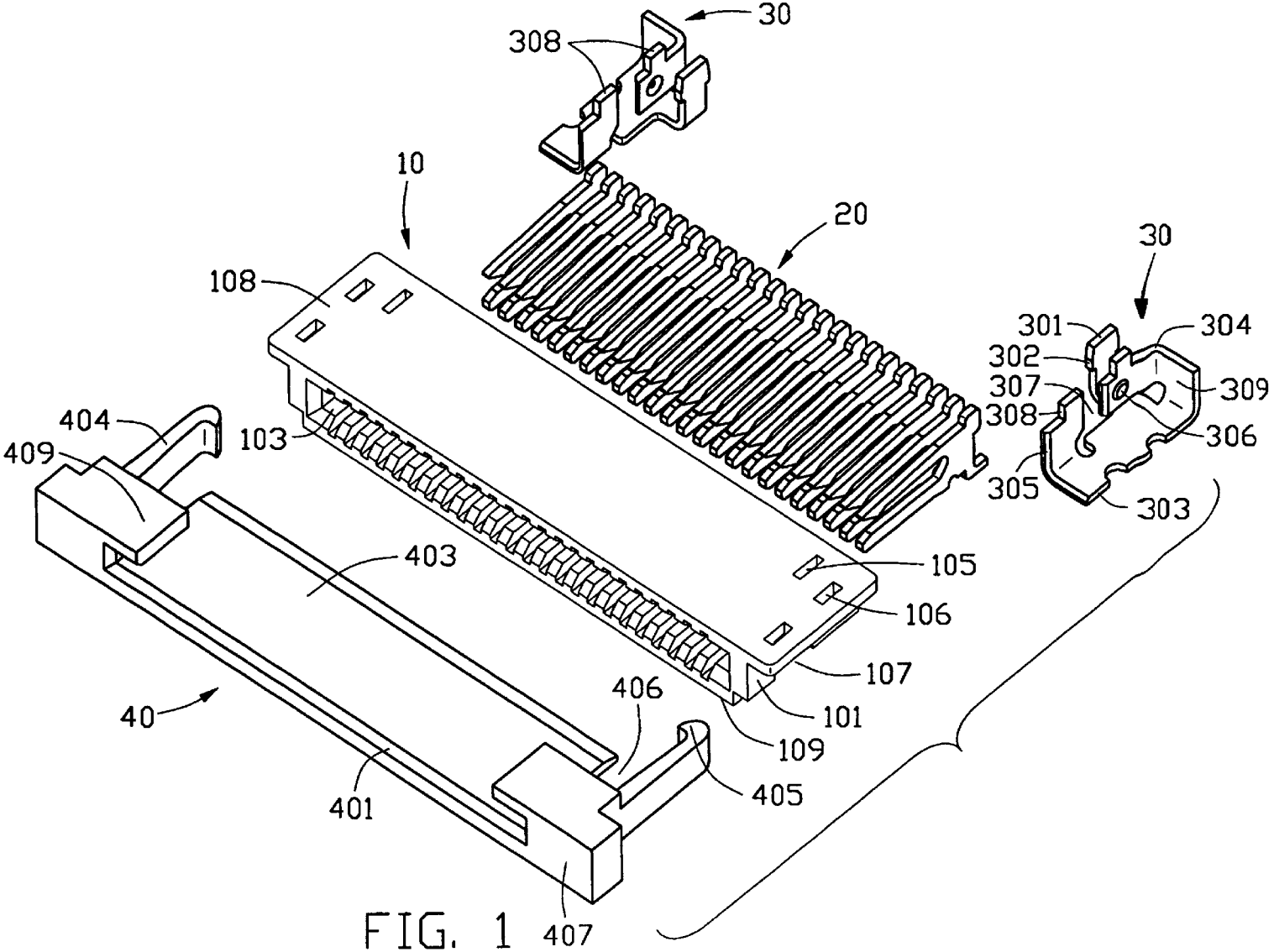
FIG. 1 is an exploded view of a flexible printed circuit (FPC) connector of the present invention.

Referring to FIGS. 1 through 4, an electrical connector for use with a flexible printed circuit (FPC) according to the present invention has a substantially rectangular insulating housing 10, a plurality of contact elements 20 received within the housing 10, and a slider 40 insertably mounted to the housing 10 for driving an FPC 5 inserted into the insulating housing 10 to contact with the contact elements 20. A pair of solder pads 30 are mounted on opposite sides of the housing 10 for securing the connector to a printed circuit board (not shown).

The insulating housing 10 has a top wall 108, a bottom wall 109, and a pair of side walls 101 opposite to each other. A hollow portion 103 is defined by the top wall 108, the bottom wall 109, and the side walls 101. The top wall 108 defines a pair of first apertures 106 near each side wall 101 and aligned in a front-to-rear direction. A pair of second apertures 105 is disposed on both sides of the top wall 108 and is located to an inside of the two pairs of first apertures 106 toward a front edge of the top wall 108. A cutout 107 is defined in a lower portion of each side wall 101.

Particularly referring to FIG. 1, the slider 40 has a body portion 401, a planar pressure portion 403 extending forwardly from a front edge of the body portion 401, and a pair of actuation portions 407 formed on opposite sides of the body portion 401. A latching arm 404 projects forwardly from each actuation portion 407. A recess portion 406 is defined between the body portion 401 and each latching arm 404. Each actuation portion 407 has a projecting portion 409 extending inwardly from an upper edge thereof for retaining the FPC 5. Each latching arm 404 has a latching fluke 405 projecting inwardly from a front end thereof.

Each solder pad 30 has a planar base 303 for soldering to the printed circuit board. A transition portion 309 upwardly projects from a front portion of the base 303. A first mounting wall 304 extends perpendicularly and rearwardly from a side of the transition portion 309. A second mounting wall 305 projects from a rear side of the base 303 in a plane common with the first mounting wall 304. A retention portion 301 laterally and perpendicularly extends from an edge of the base 303 and is offset in an inward direction from the first and the second mounting walls 304, 305. The retention portion 301 has a barb 302 protruding from front and rear ends thereof. A gap 307 is defined between the first and the second mounting walls 304, 305. Each of the first and the second mounting walls 304, 305 has a protuberance 308 on a top edge thereof. A projection 306 is outwardly formed on an outer surface of the first mounting wall 304.

Referring to FIGS. 2 through 6, in assembly, the contact elements 20 are inserted into the insulating housing 10 from a front end of the housing 10. The solder pads 30 are mounted on opposite sides of the housing 10. Each of the first and second mounting walls 304, 305 has an inner surface abutting against the outer surface of a corresponding side wall 101. The retention portion 301 of each solder pad 30 enters into a corresponding second aperture 105, with the barb 302 of the retention portion 301 locking in the second aperture 105. The protuberances 308 of the first and the second mounting walls 304, 305 respectively engage with the corresponding first apertures 106. The gap 307 of each solder pad 30 is aligned with a corresponding cutout 107 of the housing 10.

Figure 2:
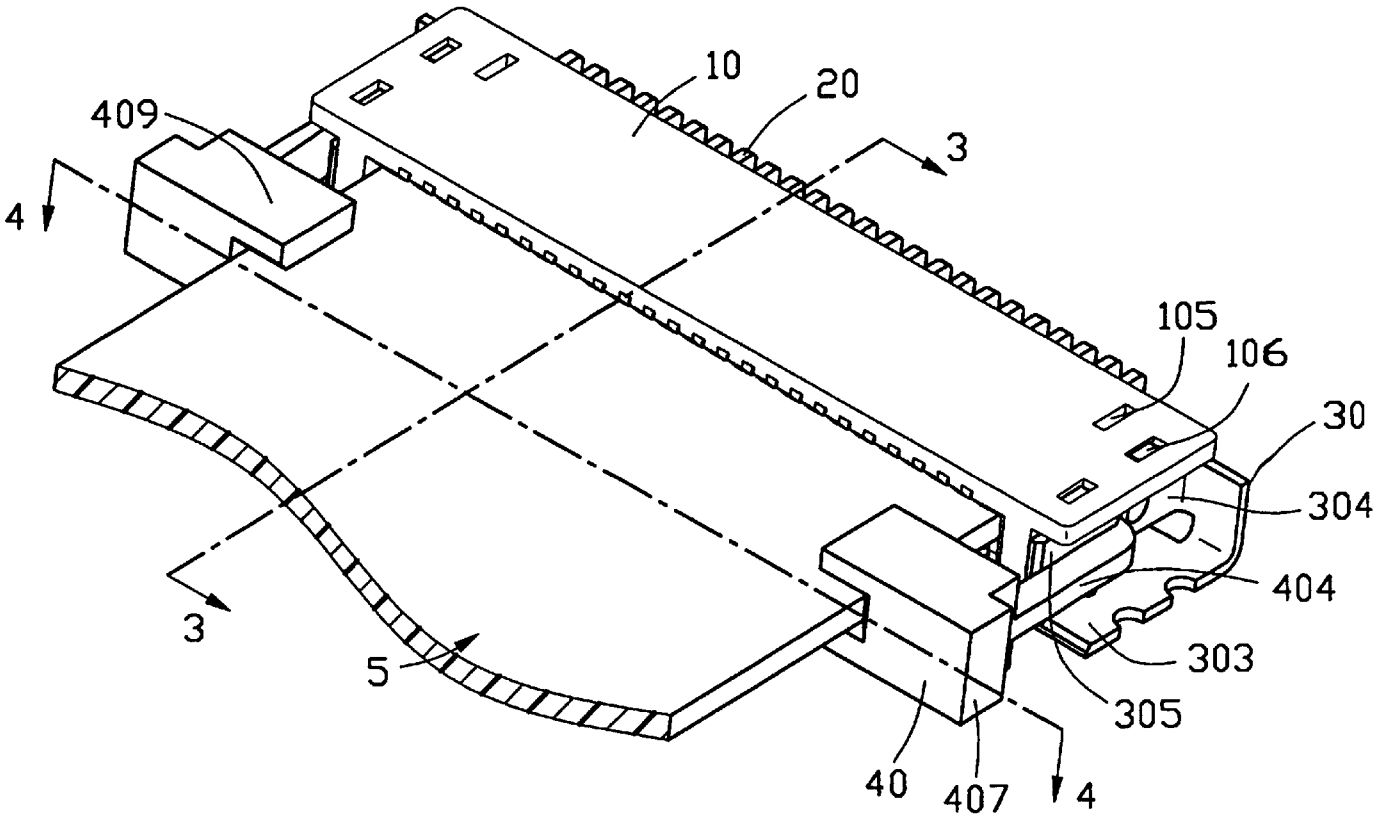
FIG. 2 is an assembled view of FIG. 1 showing an FPC inserted into the connector in a first position.
Figure 3:
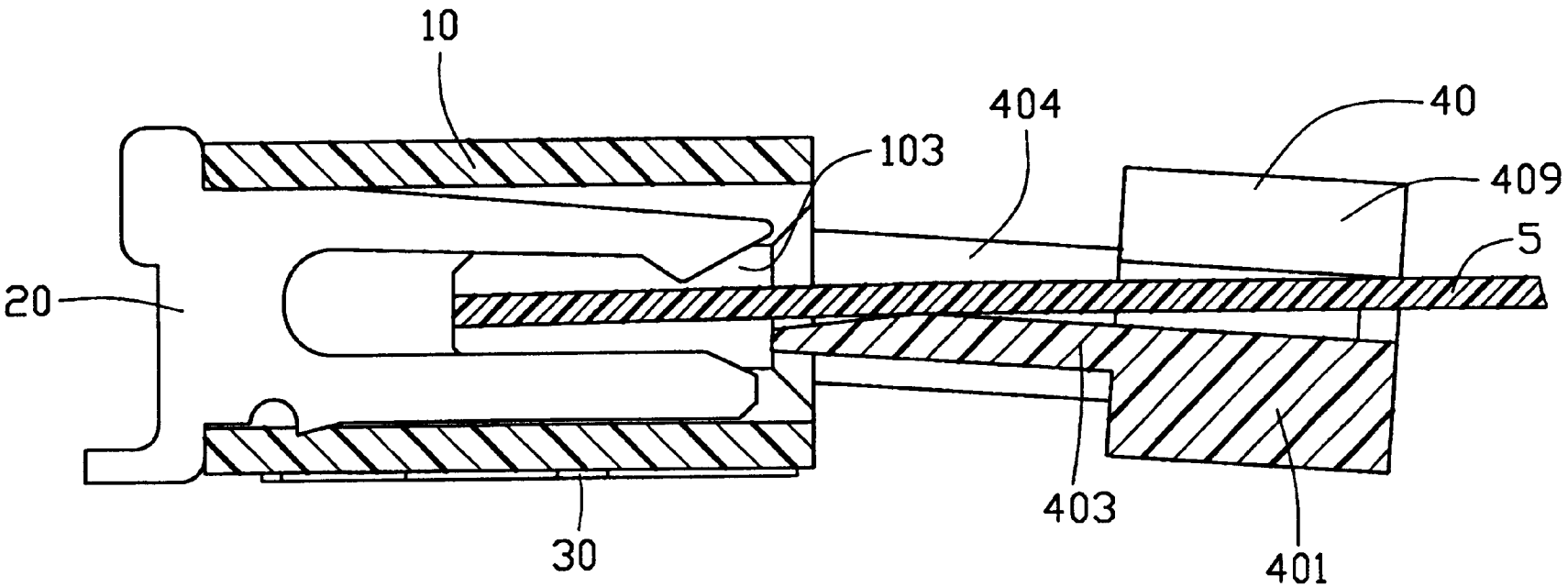
FIG. 3 is a cross-sectional view taken along line 3—3 of FIG. 2.
Figure 4:
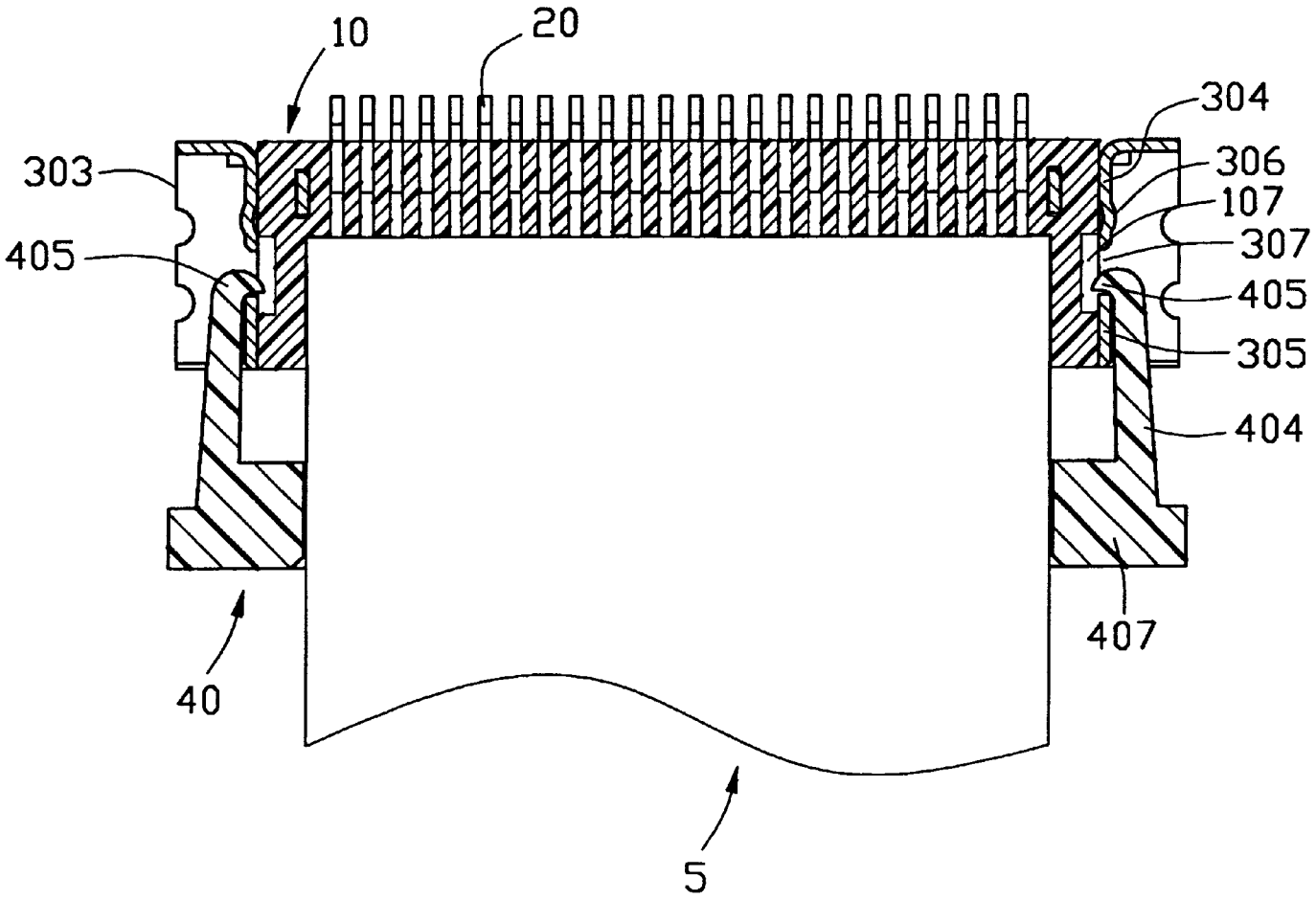
FIG. 4 is a cross-sectional view taken along line 4—4 of FIG. 2.

Particularly referring to FIGS. 2, 3 and 4, when the slider 40 is in a first position, the latching fluke 405 of each latching arm 404 extends through a corresponding gap 307 and into a corresponding cutout 107, and locks with an edge of a corresponding second mounting wall 305. The FPC 5 is free to be inserted through the slider 40 and into the hollow portion 103 of the housing 10, and is accommodated between the projecting portions 409 and the body portion 401 of the slider 40.

Figure 5:
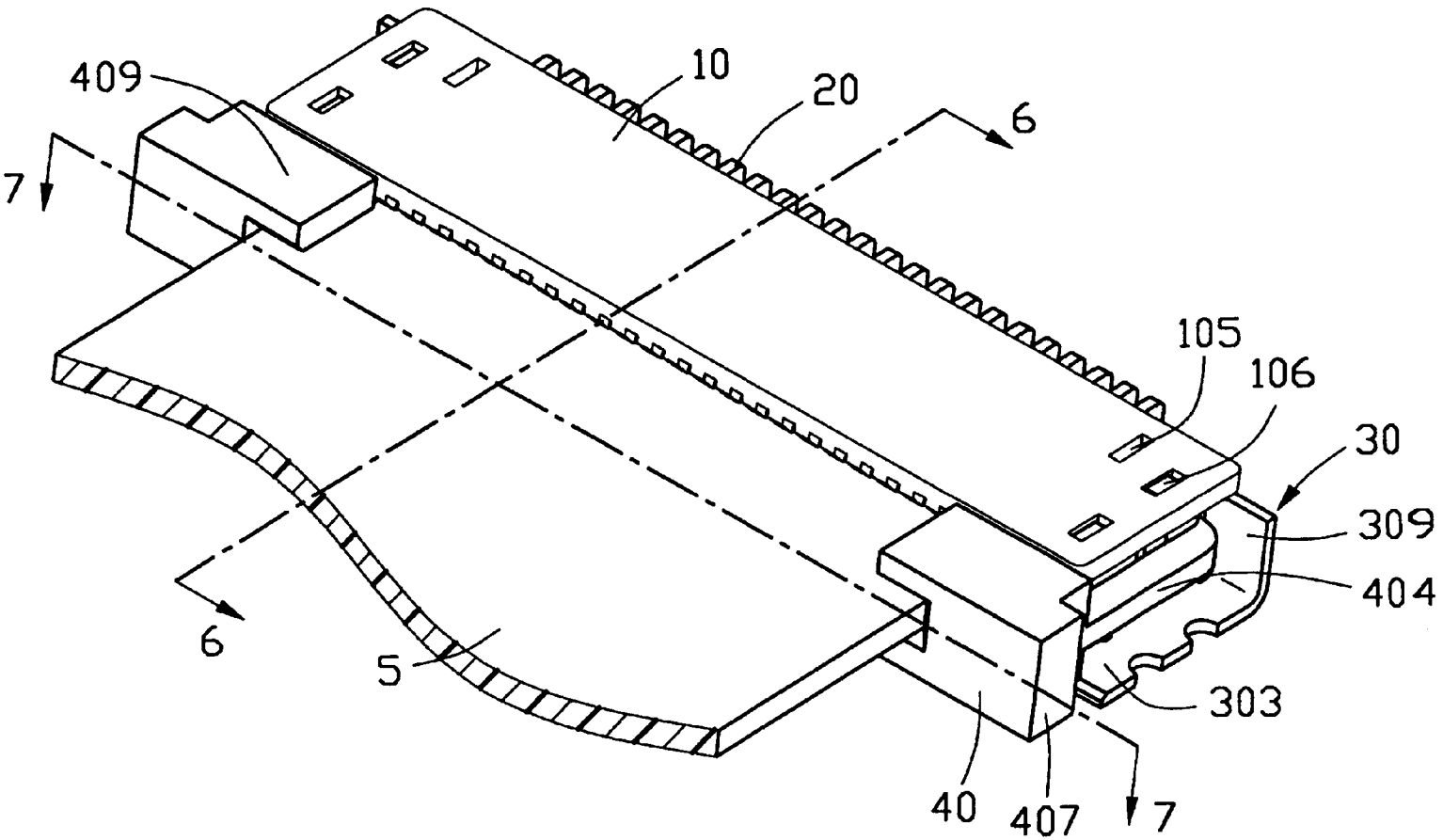
FIG. 5 is an assembled view of FIG. 1 showing the FPC inserted into the connector in a second position.
Figure 6:
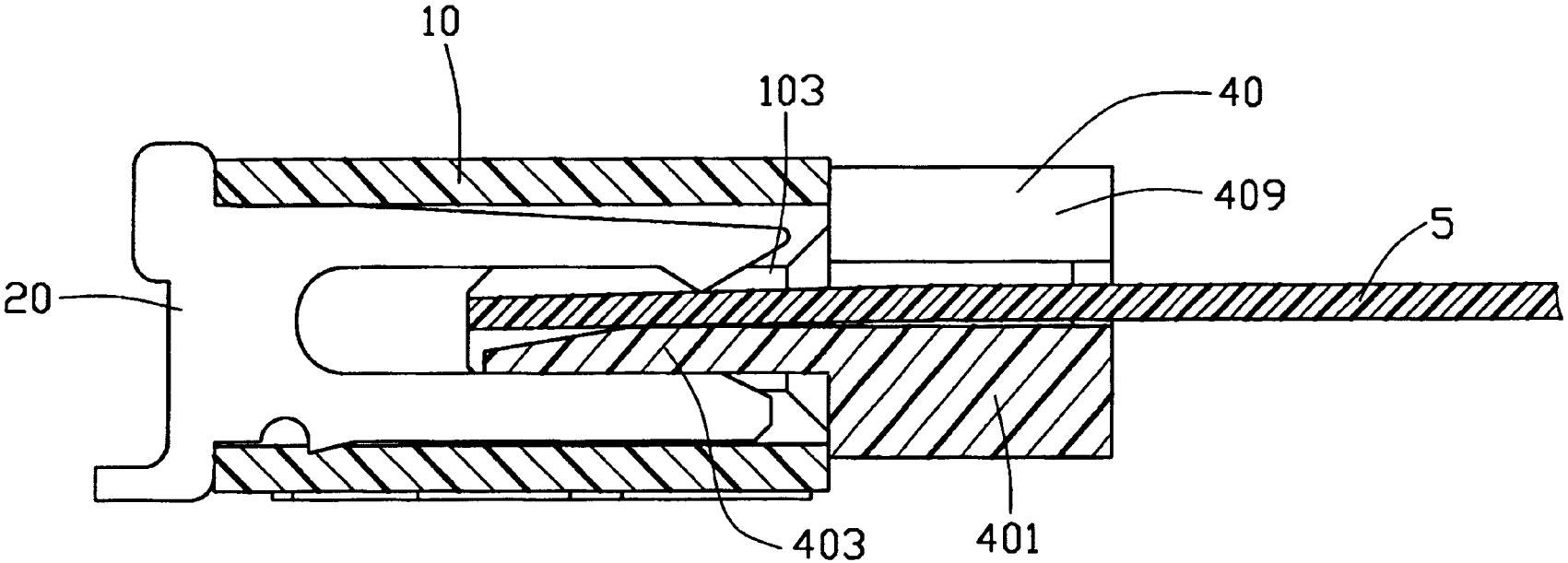
FIG. 6 is a cross-sectional view taken along line 6—6 of FIG. 5.
Figure 7:
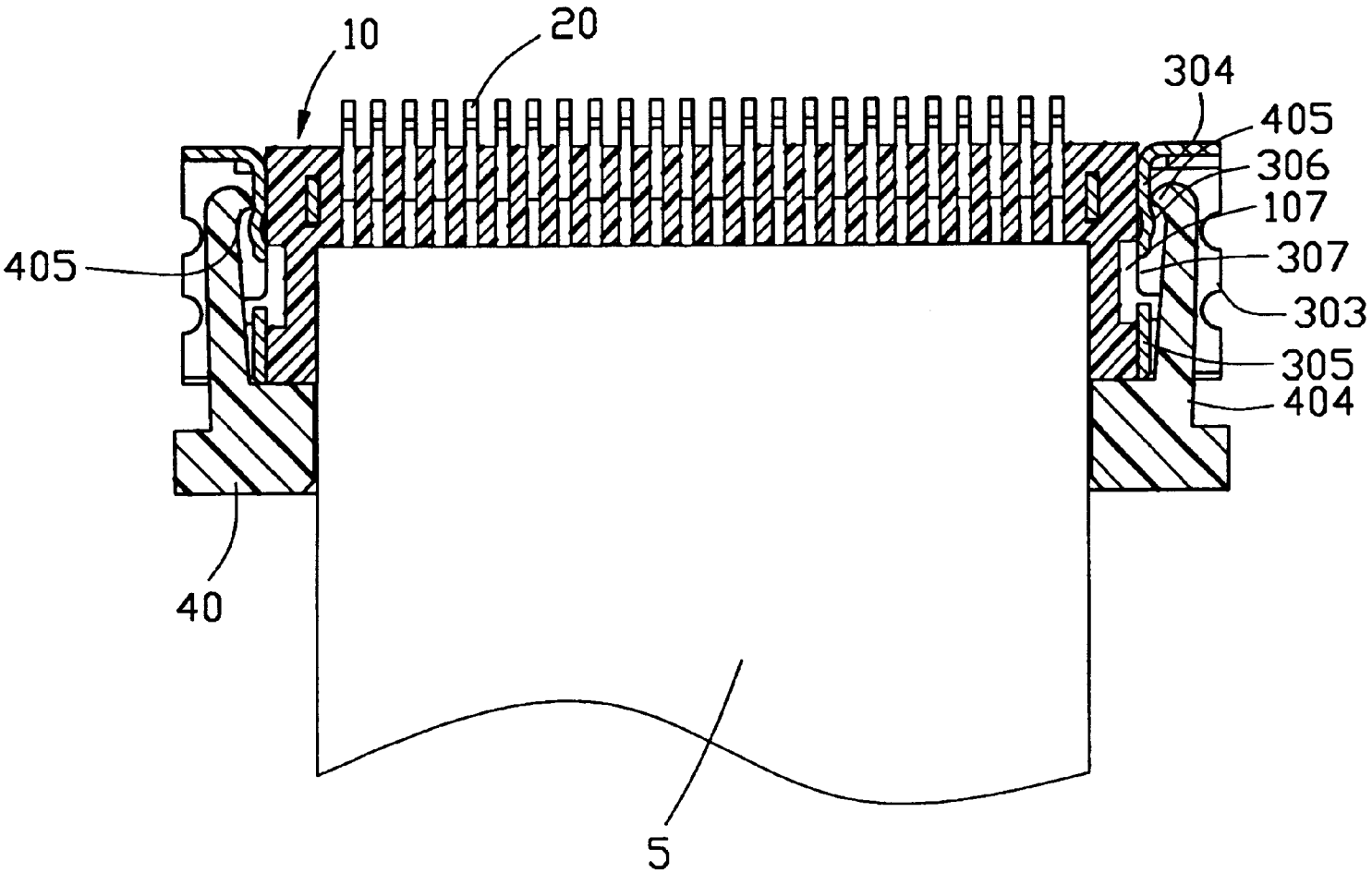
FIG. 7 is a cross-sectional view taken along line 7—7 of FIG. 5.

Particularly referring to FIGS. 5, 6 and 7, when the slider 40 is pushed to be in a second position, the latching fluke 405 of each latching arm 404 slides forward and locks with the projection 306 of a corresponding solder pad 30. Each recess portion 406 of the slider 40 receives a corresponding side wall 101 of the housing 10. The planar pressure portion 403 of the slider 40 presses the FPC 5 against the contact elements 20. The FPC 5 electrically connects with the contact portions (not labeled) of the contact elements 20.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector adapted for connecting with a flexible printed circuit (FPC), comprising:

an insulating housing;

a plurality of contact elements received in the housing;

a pair of solder pads mounted on opposite sides of the housing and adapted to be secured to a printed circuit board, each solder pad having a first and a second mounting walls, a gap being defined between the first and the second mounting walls, a projection being formed on the first mounting wall; and a slider forming a pair of latching arms on opposite sides thereof, each latching arm having a latching fluke projecting inwardly from a front end thereof, the slider being movable between a first position in which the latching fluke of each latching arm extends into the gap and locks with a front edge of a corresponding second mounting wall to permit insertion of an FPC, and a second position in which each latching fluke locks with the projection of a corresponding first mounting wall of the solder pad for securing the FPC in the housing.

2. The electrical connector according to claim 1, wherein the insulating housing forms a pair of side walls on opposite sides thereof, a cutout being defined in a lower portion of each side wall, and wherein when the slider is in the first position, the latching fluke of each latching arm extends through the gap and into the cutout.

3. The electrical connector according to claim 1, wherein the insulating housing comprises a top wall defining a pair of first apertures near each of two side walls of the insulating housing, and wherein a protuberance projects from a top edge of each of the first and second mounting walls for locking with corresponding first apertures.

4. The electrical connector according to claim 3, wherein a pair of second apertures are defined in the top wall of the housing and each second aperture is offset from a corresponding pair of first apertures, and wherein each solder pad further has a retention portion offsets from the first and the second mating walls for entering into a corresponding second aperture.

5. The electrical connector according to claim 4, wherein each retention portion forms a barb on a side thereof for locking with a corresponding second aperture.

6. The electrical connector according to claim 1, wherein the slider has a pair of actuation portions on opposite sides thereof for manual operation.

7. The electrical connector according to claim 6, wherein each actuation portion has a projecting portion projecting inwardly for retaining the FPC.

8. An electrical connector for use with a flexible printed circuit (FPC), comprising:

an insulative housing defining a hollow portion therein;

a plurality of contacts received within the housing and exposed to said hollow portion;

a slider including planar pressure portion and a pair of latching arms at two opposite ends thereof, said planar pressure portion adapted to be received within the hollow portion; and a pair of solder pads retained at two ends of the housing for mounting the connector to a printed circuit board; wherein each of said solder pads defines first and second portions respectively latchably engaged with the corresponding latching arm located in a first position where the planar pressure portion of the slider is initially inserted into the hollow portion for facilitating insertion of the FPC and in a second position where the planar pressure portion of the slider is fully inserted into the hollow portion for retaining the FPC in the housing.

* * * * *